US005094903A

United States Patent [19]

Elzey

[11] Patent Number: 5,094,903

[45] Date of Patent: Mar. 10, 1992

[54] HANGER FOR SEPARATING STORED SHEET MATERIAL

[75] Inventor: Paul B. Elzey, Kalamazoo, Mich.

[73] Assignee: EFP Corporation, Elkhart, Ind.

[21] Appl. No.: 632,370

[22] Filed: Dec. 21, 1990

[51] Int. Cl.[5] ..... B32B 9/00

[52] U.S. Cl. ..... 428/192; 24/563; 24/566; 206/448; 206/454

[58] Field of Search ..... 428/34, 192; 156/109; 24/530, 545, 563, 566; 206/448, 454

*Primary Examiner*—Patrick J. Ryan

*Assistant Examiner*—Elizabeth Evans

*Attorney, Agent, or Firm*—James D. Hall

[57] ABSTRACT

A hanger which includes two depending strips of resilient material interconnected at their upper margins by a flexible link which enables the hanger at its link to be placed over the upper marinal edge of a sheet of material with the strips straddling of the sheet material and thus acting as a spacer preventing contact between adjacent sheets of material stacked in an upright orientation.

4 Claims, 1 Drawing Sheet

HANGER FOR SEPARATING STORED SHEET MATERIAL

BACKGROUND OF THE INVENTION

This invention relates to a hanger utilized for separating sheets of material during shipment and storage and will have particular application to the separation of stacked windshields prior to their installation within vehicles.

Heretofore, windshields have been separated from each other during shipment or storage by generally three ways. It has been common for sheets of polystyrene or similar non-abrasive resilient material to be placed between the windshields. Such sheeting which can range 30" in length and 30" in width and is expensive to produce and somewhat cumbersome to handle. Additionally, strips of resilient material having an adhesive applied to one side covered prior to application by a peelable protective covering have been applied to one side of the glass windshields. This form of protection is time-consuming to apply since the peelable layers first must be removed from over the adhesive and then the strips applied diligently to the windshield. Also, there have been elongated channel-shaped protective members which are fitted over, usually the upper edge, of the windshield. These panels are formed either by gluing two previously formed strips of material together at an upper or by extruding an elongated inverted U-shaped channel member. The cost of such protective members are relatively expensive.

In the following described invention, a protective hanger is provided which is formed of minimal material and which can be applied in a simple and rapid manner to adequately protect adjacent stacked or stored sheet material from contacting one another.

SUMMARY OF THE INVENTION

This invention relates to a hanger which is used to separate adjacent upright stacked sheet material and which includes two elongated strips connected at their upper margins by a flexible link. The hanger is applied over the upper marginal edge of the sheet material with the flexible link contacting and overlying the upper marginal edge and with the strips each positioned on opposite sides of the sheet material. In this manner the strips form spacers preventing the adjacent sheet material from contacting the hanger carrying sheet material. Where several sheets of material are stacked side by side, alternate or every other sheet may have the hanger of this invention applied over its upper marginal edge to prevent the sheets from contacting each other.

Accordingly, it is an object of this invention to provide a spacer which separates sheets of material.

Another object of this invention is to provide a spacer which is in the form of a hanger for separating sheets of glass one which is of economical construction.

Still another object of this invention is to provide a hanger applied over upper marginal edges of stacked sheets of glass to prevent contact between the sheets and which can be applied in a simple and rapid manner.

Other objects of this invention will become apparent upon a reading of the following description.

BRIEF DESCRIPTION OF THE DRAWINGS

A preferred embodiment of this invention has been chosen for purposes of illustration and description wherein.

DESCRIPTION OF THE PREFERRED EMBODIMENT

The preferred embodiment illustrated is not intended to be exhaustive or to limit the invention to the precise form disclosed. It is chosen and described in order to best describe the principles of the invention.

Figure 1:
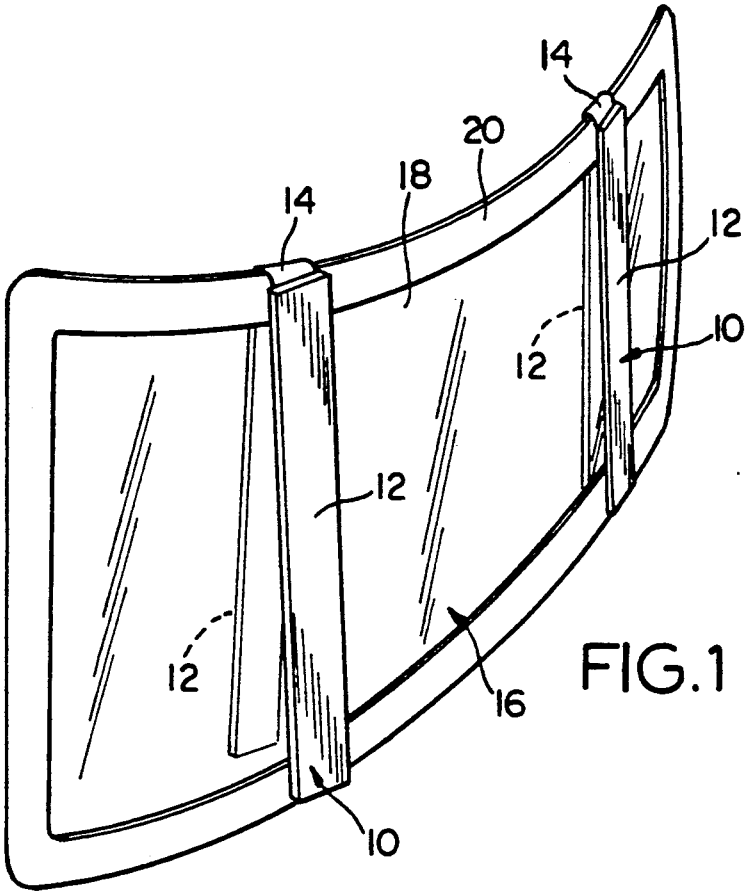
FIG. 1 is a perspective view of a windshield utilizing a pair of the hangers of this invention.
Figure 2:
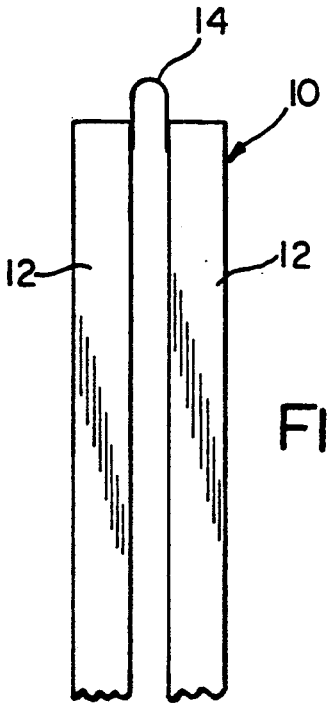
FIG. 2 is a fragmentary side view of one of the hangers shown in FIG. 1.
Figure 3:
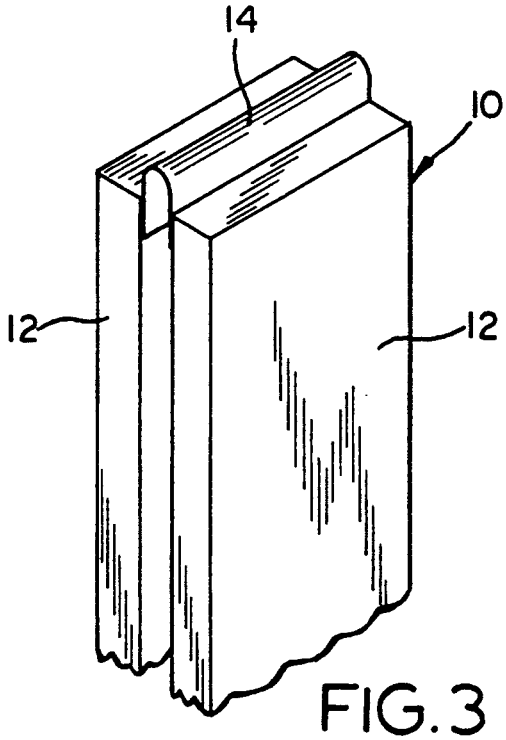
FIG. 3 is a fragmentary perspective view of one of the hangers shown in FIG. 1.

Each hanger 10 includes a pair of elongated strips 12 which are preferably of a resilient, lightweight material, such as polystyrene. Strips 12 are connected at their upper marginal edge portions by a flexible link 14. Link 14 may be secured to strips 12 in any of a variety of ways, such as by an adhesive or similar bonding agent, and is preferably of high tensile strength. One such material suitable for link 14 is polyethylene. The length of each link 14 as it extends between strips 12 is sufficient to allow the hanger to be looped over the upper marginal edge of the sheet material and, thus, should slightly exceed the thickness of the sheet material at its upper marginal edge. In FIG. 1, a windshield 16 is illustrated as the sheet material and includes a glass panel 18 surrounded by a molding 20. It is to be understood that the windshield need not necessarily include molding 20.

For elongated sheet material such as windshield 16, a pair of hangers 10 are preferably utilized. For sheet material of less length, one or a single hanger may be sufficient to prevent contact between adjacent sheets of upright stacked material. The hangers 10 in FIG. 1 may be applied simultaneously over the windshield with each of the strips 12 of each hanger being positioned on opposite sides of the windshield. The length of strips 12 are preferably dimensioned so as to extend a substantial width of the windshield. Although for other applications of for other types of sheeting material, it may not be necessary for strips 12 to extend any further than is necessary to accomplish the spacing task desired for the type of sheet material. Spacers 10 may need only be applied to alternate or every other item sheet of sheet material in order to prevent the sheet material from contacting one another.

The invention is not to be limited to the details above given but may be modified within the scope of the appended claims.

I claim:

1. In combination, a plurality of sheets of upright stacked material each having an upper marginal edge portion, and a hanger separating adjacent said sheets, said hanger comprising two elongated strip parts having upper ends and a flexible link connected between said strip parts at their upper ends, said hanger fitted over one of said sheets with said link contacting said upper marginal edge portion of said one sheet and having one of said strip parts extending downwardly along one side of the sheet and the other of said strip parts extending downwardly along the other side of the sheet.

2. The combination of claim 1 wherein said strip parts extend substantially the full width of said one sheet.

3. The combination of claim 2 and a second hanger spaced from said first mentioneds hanger and fitted over said one sheet with said link thereof contacting said upper marginal edge portion of said one sheet and having one of said strip parts thereof extending downwardly along said one side of the sheet and the other of said strip parts thereof extending downwardly along said other side of the sheet.

4. The combination of claim 3 wherein said strip parts are resilient.

* * * * *